US005743096A

United States Patent [19]

Blanton et al.

[11] Patent Number: 5,743,096

[45] Date of Patent: Apr. 28, 1998

[54] CONTROLLED DOSING OF LIQUID CRYOGEN

[75] Inventors: Russell Blanton, Acton; John W. Ross, Ipswich; Thorton Stearns, Winchester, all of Mass.

[73] Assignee: Vacuum Barrier Corporation, Woburn, Mass.

[21] Appl. No.: 631,187

[22] Filed: Apr. 11, 1996

[51] Int. Cl.[6] ..... F17C 7/02

[52] U.S. Cl. ..... 62/50.1; 62/50.5

[58] Field of Search ..... 62/50.1, 50.5

[56] References Cited

U.S. PATENT DOCUMENTS

| | | | |
|---|---|---|---|
| 3,794,039 | 2/1974 | Kollner et al. . | |
| 3,972,202 | 8/1976 | Stearns . | |
| 4,349,358 | 9/1982 | Tarancon . | |
| 4,715,187 | 12/1987 | Stearns . | |
| 4,796,434 | 1/1989 | Garnretter | 62/50.5 |
| 4,848,093 | 7/1989 | Simmonos et al. | 62/50.1 |
| 4,854,128 | 8/1989 | Zeamer | 62/50.1 |
| 4,865,088 | 9/1989 | Stearns . | |
| 4,899,546 | 2/1990 | Eigenbrod . | |
| 5,169,031 | 12/1992 | Miller | 62/50.2 |
| 5,353,849 | 10/1994 | Sutton et al. . | |
| 5,400,601 | 3/1995 | Germain et al. | 62/50.2 |
| 5,533,341 | 7/1996 | Schvester et al. | 62/50.1 |

*Primary Examiner*—Ronald C. Capossela
*Attorney, Agent, or Firm*—Fish & Richardson P.C.

[57] ABSTRACT

The invention relates to systems and methods for delivering controlled doses of a liquid cryogen. Controlling a restriction in a return conduit and other system geometry maintains proper circulation through a delivery and return conduit, enabling reliable control over the temperature and pressure of the liquid cryogen at the site of dosing.

19 Claims, 7 Drawing Sheets

CONTROLLED DOSING OF LIQUID CRYOGEN

BACKGROUND OF THE INVENTION

This invention relates to systems and methods for delivering controlled doses of a liquid cryogen, such as liquid nitrogen.

In some processes, it is important to deliver a known amount of a cryogenic liquid. For example, doses of liquid nitrogen are delivered to containers that are then capped immediately in a beverage packaging line so that nitrogen vaporizing after capping pressurizes the container, as described in U.S. Pat. No. 4,715,187, incorporated herein by reference. In that process, the amount of liquid delivered must be carefully controlled. If too little liquid cryogen is administered, the container may collapse when it experiences significant forces. If too much liquid cryogen is delivered, excessive pressure builds up in the container causing it to deform or rupture. Even when liquid cryogen (usually nitrogen) is provided as a source of inert gas in the container and not to pressurize it, cryogen delivery must be reliable and consistent without gaps or surges of liquid.

Controlling the amount or dose of liquid nitrogen delivered can be difficult, particularly if the doses must be rapidly administered as is the case for a high speed canning or bottling assembly line. The large change in density resulting from vaporization of liquid means that devices dispensing a predetermined volume of fluid, e.g. valves, will not provide consistent amounts of cryogen unless the vapor/liquid state of the fluid is controlled.

Flashing, i.e., rapid vaporization of liquid cryogen upon release from prior containment under pressure, also tends to hamper control over the amount of liquid cryogen delivered to a container.

SUMMARY OF THE INVENTION

In general, the invention features systems and methods in which liquid cryogen is delivered from a phase separating reservoir via a feed conduit to a valved outlet that is below the reservoir. The outlet valve may be a dosing valve that is repeatedly opened and closed to provide rapid controlled doses of cryogen delivered in pulses.

We have discovered that, by carefully controlling cryogen recirculation, it is possible to maintain a consistent flow rate and pressure for cryogen delivery from the outlet. Recirculation is provided by a recirculation path that includes a return conduit extending from the feed conduit at point P (immediately upstream of the outlet) upwardly to the vapor in the reservoir. The feed conduit and the return conduit are thermally isolated from each other, so that the return conduit may be kept very slightly warmer than the supply conduit, ensuring flow in the system. The slightly warmer cryogen in the return conduit will have a slightly lower density than does cryogen in the feed conduit, thus supporting a circulation of cryogen down the feed and up the return conduits, to maintain a supply of liquid cryogen at point P for delivery through the valve. The geometry of the system is controlled to control the recirculating flow, in that the return conduit has a minimum cross-sectional area restriction $A_R$ designed to maintain adequate flow in the recirculation path. Cryogen at point P is replenished by reliable circulation down the feed conduit and up the return conduit.

Preferably, recirculation is such that at any given time the cryogen provided to point P from the reservoir (which experiences a lower pressure than the pressure at P) will not have absorbed heat so as to reach liquid/vapor equilibrium at the higher pressure experienced at point P. In that event, the cryogen to be delivered at point P is sub-cooled. Also preferably, the liquid pressure head communicated through the feed conduit to point P is high enough to maintain adequate cryogen flow through the outlet, yet low enough to reduce or avoid flashing at the outlet.

The feed conduit and the return conduit typically are parallel but not concentric, and thermally reflective foil extends around both the feed and the return conduit. At least one insulating layer is included between the foil and the feed conduit, while the foil is in direct contact with the return conduit. In this way, heat leak from outside the apparatus is diverted from the feed conduit and is concentrated in the return conduit.

Alternatively, the feed conduit and the return conduit may be concentric, the feed conduit being inside the return conduit and insulated from it by an evacuated space and/or other insulation such as glass fiber insulation. The foil surrounds and contacts the outside of the return conduit to divert heat leak to the return conduit.

Preferably, the reservoir is positioned above the outlet a predetermined vertical distance D to provide a predetermined pressure head of liquid through the delivery conduit to point P. Usually, the pressure in the reservoir is atmospheric, but it may be higher to enhance flow over that provided entirely by the gravity head. Alternatively, the pressure experienced in the reservoir may be kept below atmospheric to enhance the sub-cooling at point P.

In preferred embodiments, the dosing valve comprises a chamber communicating with a cryogen source to continuously bathe the valve in the liquid cryogen.

The above-described apparatus controls the temperature and pressure of liquid cryogen at the dosing point to allow delivery of known amounts of liquid cryogen, with an extraordinarily simple mechanism. Preferably, the delivery pressure is controlled to be low enough to subcool the liquid and to avoid excessive flashing and to provide adequate amounts of cryogen in liquid form upon release of the liquid to atmospheric pressure. Problems such as cycling (described below) and flashing are avoided.

Other features and advantages of the invention will be apparent from the following description of the preferred embodiment thereof, and from the claims.

DESCRIPTION OF THE PREFERRED EMBODIMENTS

Figure 1A:
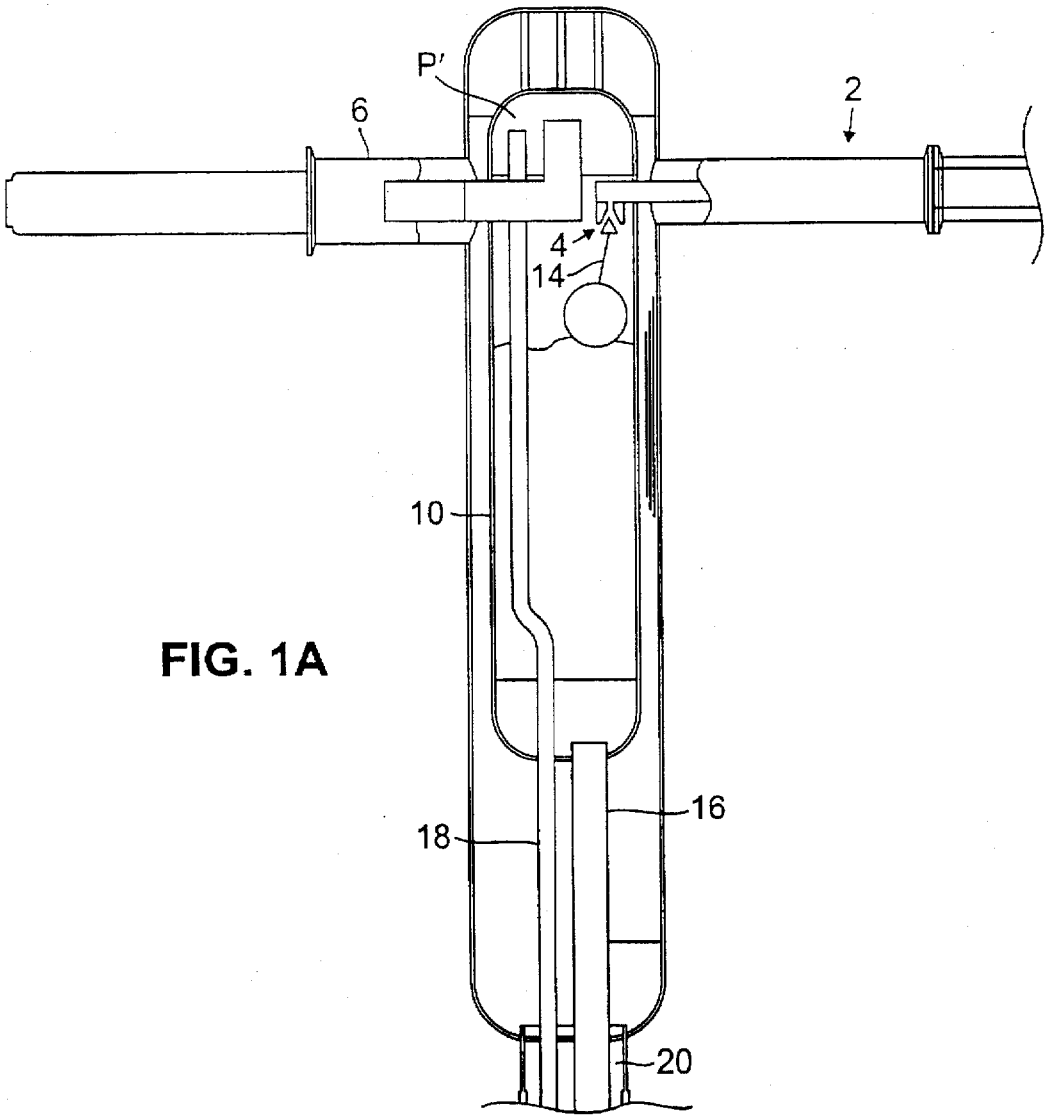
FIG. 1A is a schematic diagram of the upper portion of a liquid cryogen delivery system for controlled dosing of liquid cryogen.

Referring to FIGS. 1A–1D, cryogen is supplied from a pressurized source and travels through vacuum jacketed piping 2 to the inlet 4 of phase separating reservoir 10. A porous stainless steel filter is located in the piping 2 before inlet 4, which prevents unwanted particles from entering the reservoir. As the two-phase cryogen mixture flows into the reservoir 10, the gas phase is vented to atmosphere through vent conduit 6. The liquid phase collects in reservoir 10 and is maintained at a constant level by a float valve 14. Liquid flows freely by gravity down the feed conduit 16 and fills the return conduit 18 leading back up to the headspace P' of the reservoir. The pressure head at point P adjacent the dosing valve is controlled by controlling the height of the float valve in the reservoir and the length of feed conduit 16.

For each foot of pressure head, the pressure of liquid nitrogen will increase about 0.35 psi. For each increase of 1 psi of pressure, the saturation temperature of liquid nitrogen increases about 1 degree (Rankine or Fahrenheit). In equilibrium, the saturation temperature of the liquid cryogen varies depending on the pressure it experiences and the height of the feed tube. For example, liquid nitrogen boils at –320.4° F. at atmospheric pressure, but if the pressure is raised by one psi, its boiling point becomes –319.4° F. Since liquid at a lower depth in a reservoir experiences higher pressure and since heat leaks into the reservoir,, the liquid will tend to warm to its saturation temperature.

Figure 2:
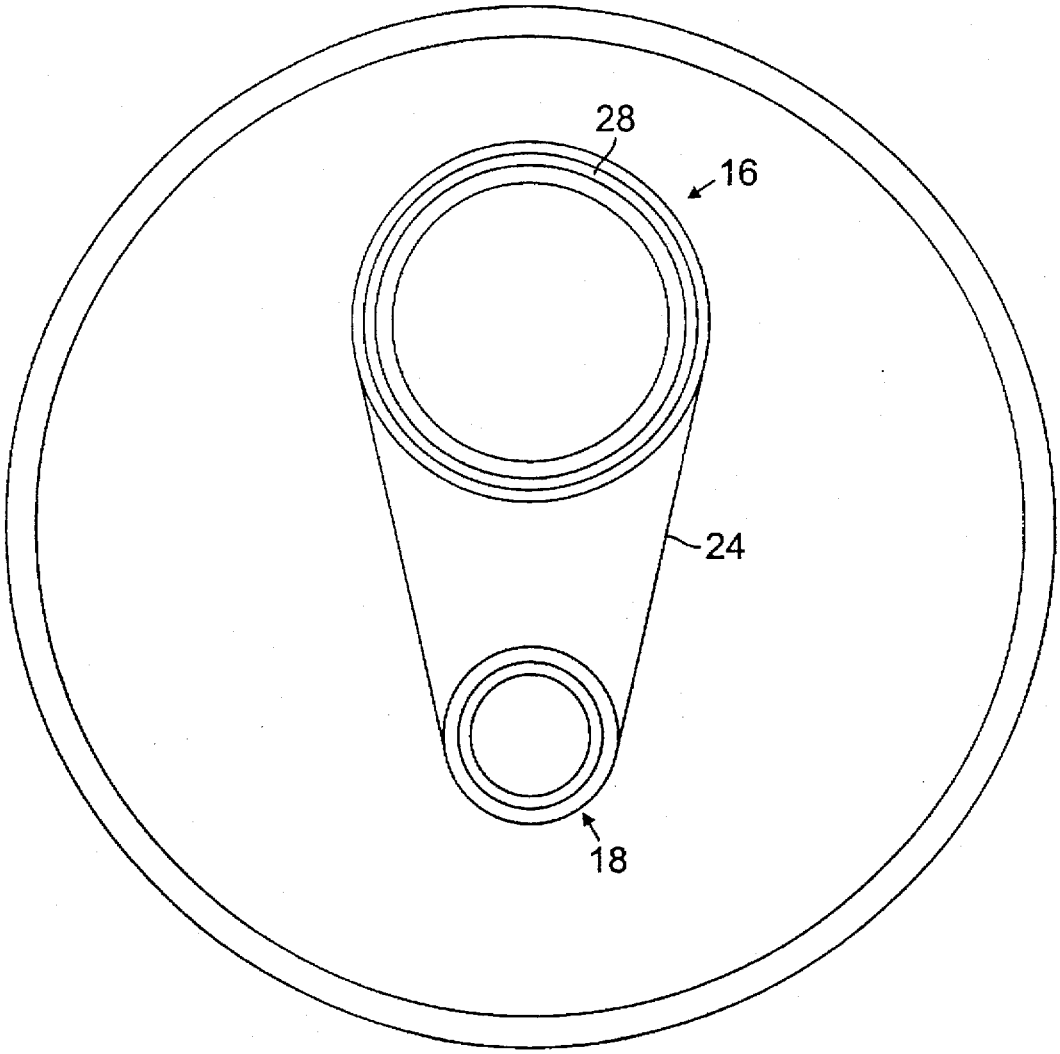
FIG. 2 is a schematic diagram of a cross-section of the feed and return conduit loop.

The liquid cryogen in the reservoir is saturated and boiling slightly due to the small heat leak through the vacuum insulated walls of the apparatus. Heat leaks primarily by radiation through vacuum space 20. As shown in FIG. 2, the feed conduit 16 is protected from the radiative heat leak by a layer of reflective foil 24 which surrounds the feed conduit. The feed conduit is insulated against direct contact with foil 24 by glass fiber insulation 28. The foil may be aluminum. The foil 24 directly contacts the return conduit 18. Since foil 24 is heat conductive and directly contacts return conduit 18, the overall heat leak from outside the apparatus is diverted to the return conduit 18, while the feed conduit is protected. Heating the liquid in return conduit 18 reduces its density relative to the feed conduit and induces circulation of the more dense liquid descending feed conduit 16 to the dosing valve 30 and rising up return conduit 18.

Liquid that circulates down feed conduit 16 experiences increasing liquid head pressure as it moves down the conduit. Since the heat leak is primarily directed into return conduit 18 and there is relatively constant circulation in the system, the temperature of the liquid rises very little as it flows down feed tube 16. Consequently, the liquid at point P just upstream of dosing valve 30 does not absorb enough heat to reach saturation, i.e., it may be in a slightly subcooled state. In this way, continuous circulation down feed conduit 16 results in a constant source of liquid at dosing valve 30 which is close to or at the saturation temperature of liquid cryogen at atmospheric pressure. When the subcooled cryogen experiences a sudden pressure drop as it exits the valve, it has less tendency to flash.

It is important to maintain control of the rate of circulation to avoid rapid periodic surges known as cycles. The phenomenon of cycling can be explained as follows.

Liquid cryogen begins to boil as it rises up return conduit 18 and thereby experiences a decrease in pressure. Boiling causes the liquid cryogen to rise still further up return conduit 18, reducing pressure and increasing the boiling rate in a reinforcing cycle. This cycle effectively accelerates the circulation until the entire feed and return conduit are replenished with lower temperature, subcooled liquid. Once this replenishment occurs, circulation will be greatly reduced or will cease entirely until liquid in the return conduit reaches its saturation temperature and begins to boil, repeating the process.

Figure 3:
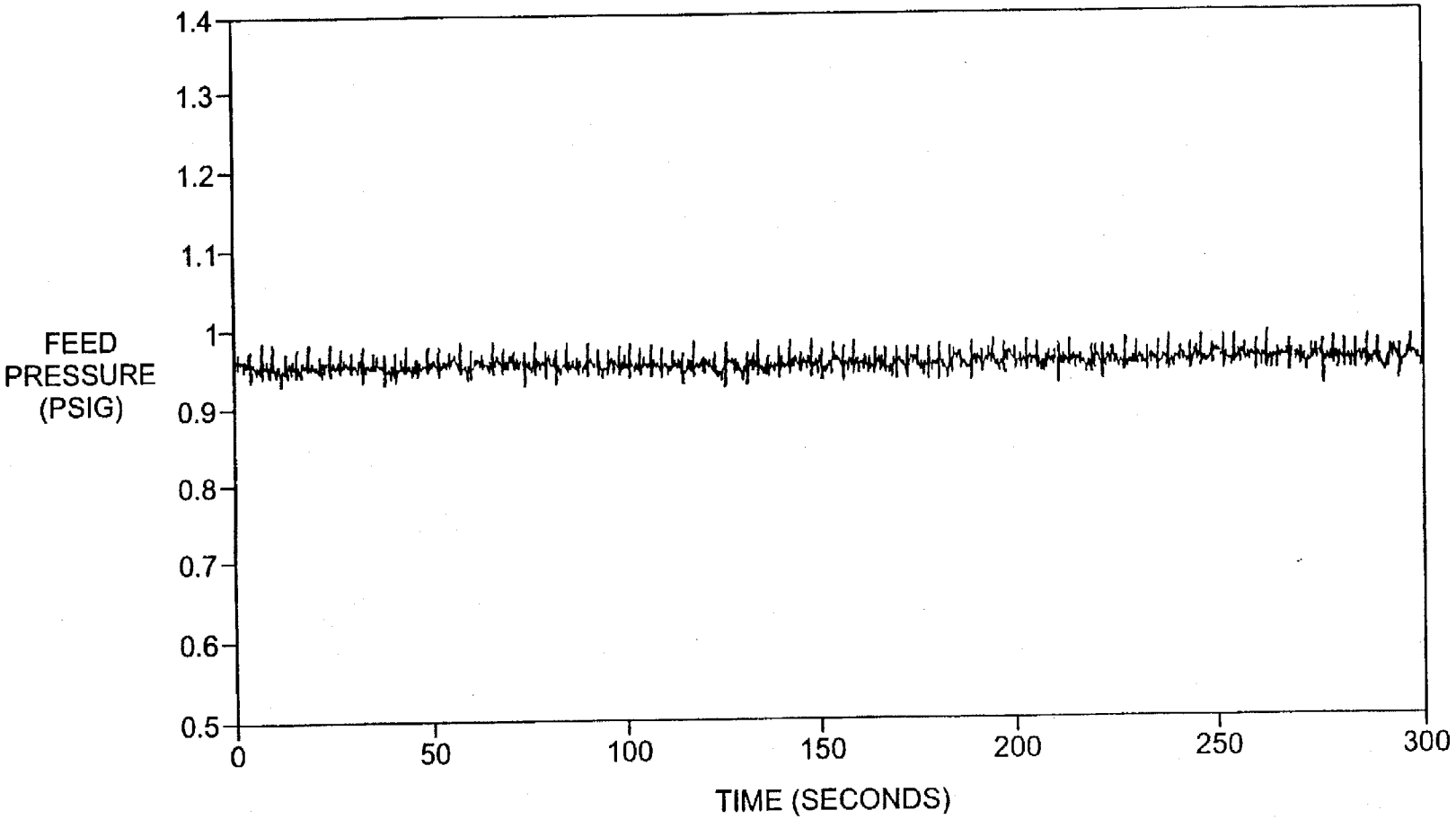
FIG. 3 is a test of feed pressure over time with the return conduit restricted.
Figure 4:
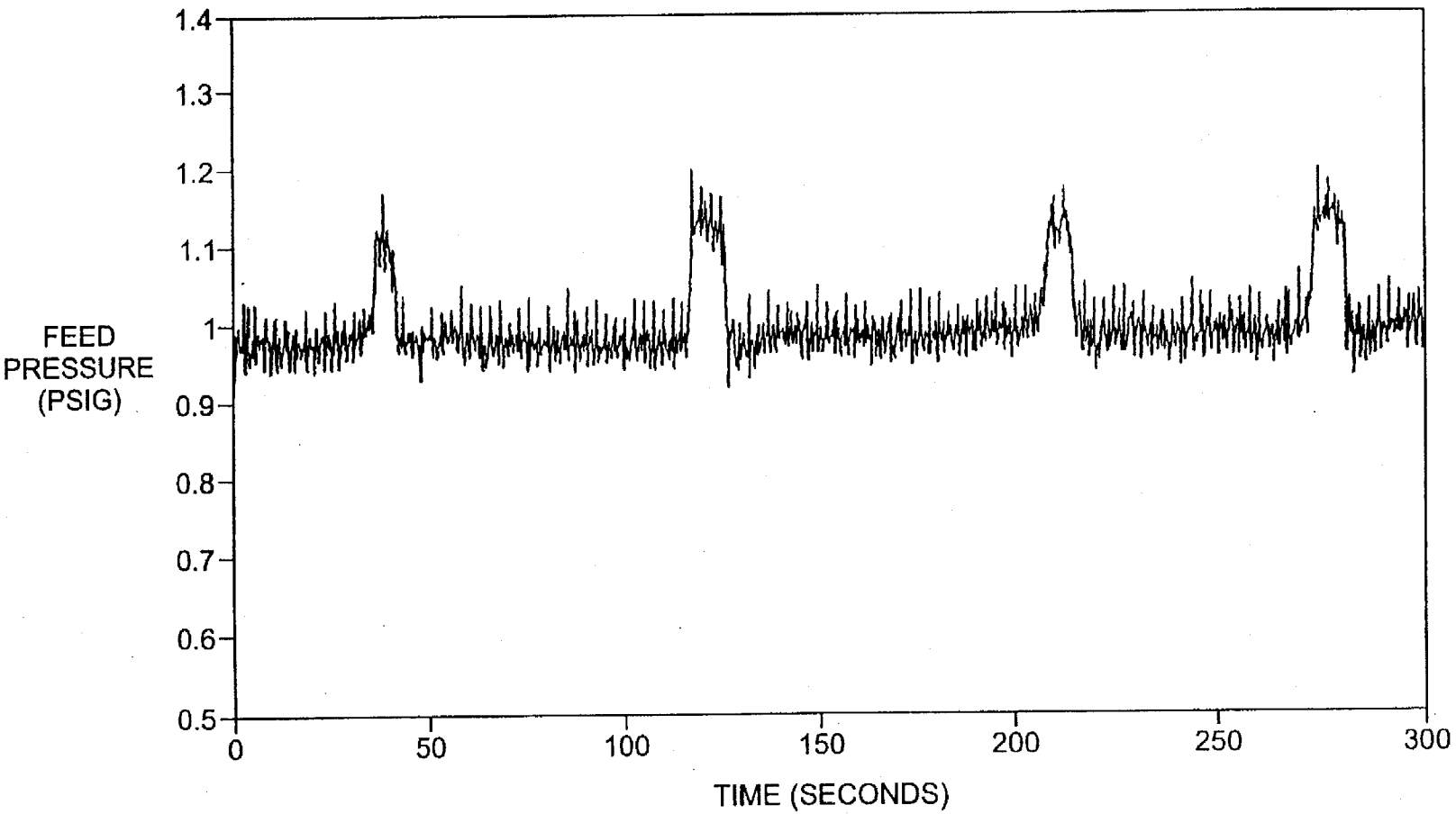
FIG. 4 is a test of feed pressure over time without a restriction in the return conduit.

To reduce or avoid cycling, restriction 45 is positioned in the lower region of the feed and return conduit loop. Restriction 45 is sized to yield steady circulation and to minimize or avoid cycling and to thereby improve uniformity of pressure and temperature at point P immediately upstream of dosing valve 30. The proper size of restriction 45 will depend on various factors, including the heat leak of the system and the desired flow rate. A typical flow rate (or cryogen use rate) is 5–80 (more preferably 10–30) pounds per hour. To verify that the restriction size is appropriate, one may establish a feed conduit of adequate internal diameter to maintain flow to the valve, and establish other components of the system as described. The system is then tested with varying return conduit restrictions by measuring the feed pressure as determined with an appropriate device (e.g., a precision pressure transducer). With no (or insufficient) restriction in the outlet, the feed pressure varies significantly over time as cycling occurs. For example, feed pressure variations of more than 0.1 psi occurring in regular cycles (e.g., cycles on the order of every 70–100 seconds), are characteristic of pressure cycling. FIG. 4 illustrates the pressure cycles observed with no restriction in the return conduit. The introduction of a restriction (or decrease in the size of an existing restriction) will eliminate or significantly reduce the magnitude of such pressure cycling, as shown in FIG. 3.

If the return conduit restriction is too small, then there will be insufficient circulation to maintain an adequate supply of subcooled cryogen at point P. This condition can be detected by measuring the temperature of liquid at point P, to detect a significant rise in the temperature. Eventually, as cryogen warms vapor may move up the feed conduit disrupting circulation. If this phenomenon is observed during testing, the restriction in the return conduit should be increased in size, to establish adequate circulation through the return conduit and the resulting stable flow.

In one specific example, the pressure head is established at between 6 and 120 inches. The feed conduit diameter is between 0.25 inches and 2.0 inches, and the return conduit restriction cross-sectional area is at least 0.003 square inches and less than about 0.010 square inches.

Figure 1B:
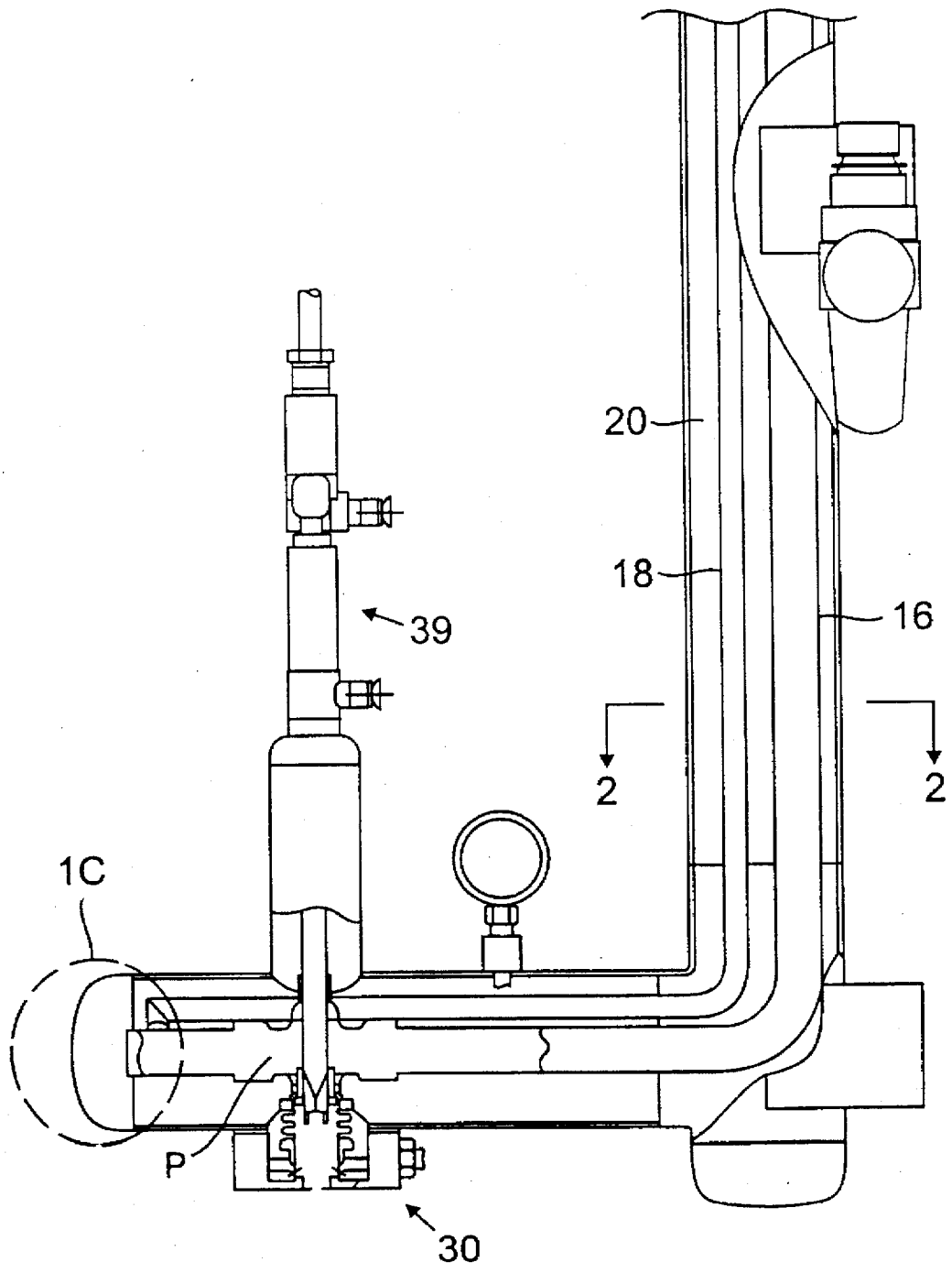
FIG. 1B is a schematic diagram of the lower portion of the system shown in FIG. 1A.
Figure 1C:
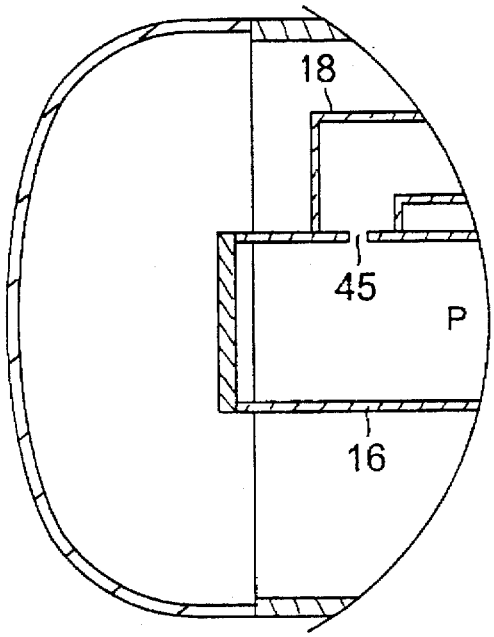
FIGS. 1C and 1D are enlargements of indicated portions of FIG. 1B.
Figure 1D:
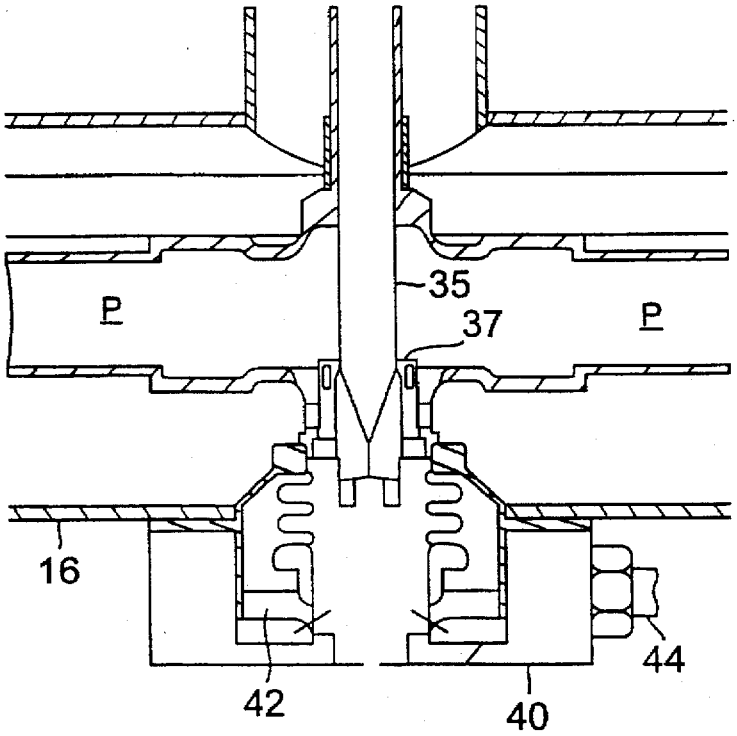

The output of liquid cryogen through the outlet is controlled by dosing valve 30 which is designed to minimize heat leak. Valve stem 35 seats on valve seat 37 (FIG. 1D) in response to controller 39, e.g., an air cylinder-activated by a solenoid (FIG. 1B). The circulating liquid cryogen continuously floods the space around valve stem 35, cooling it and the surrounding region to the temperature of the liquid cryogen. When the valve is opened, liquid cryogen delivery occurs with minimal flashing since the liquid is subcooled by the circulation process. Valve stem 35 is made from a material with a low coefficient of thermal conductivity such as a polyamide-imide plastic.

The area surrounding the valve outlet is protected from condensation of ambient moisture by the presence of a continuous dry nitrogen gas purge. A heated containment plate 40 at the outlet works in combination with the purge gas from line 44 to maintain warm, ice free surfaces during liquid cryogen dosing.

Dosing valve 30 can be operated in two modes. In the first mode, it can be opened (in response to sensing a container) for a user defined period of time resulting in the discharge of the proper amount of liquid cryogen. The valve remains closed until the next signal is received (container is sensed).

Alternatively, the valve may be held open to generate a continuous flow of liquid cryogen. This mode is particularly useful at high production rates where individual dosing amounts are less practical. The outlet controls include the capability to make the transition from discrete dosing to continuous stream at a user defined production rate threshold.

Liquid nitrogen is delivered to packages at an angle (e.g., 10–30 degrees). Using this dosing technique, interaction of the liquid with the package contents occurs at a position beyond the dosing valve, reducing possible contamination of cold inner surfaces of the liquid cryogen doser from upward bursts of droplets of product or foam produced by that interaction.

Figure 5:
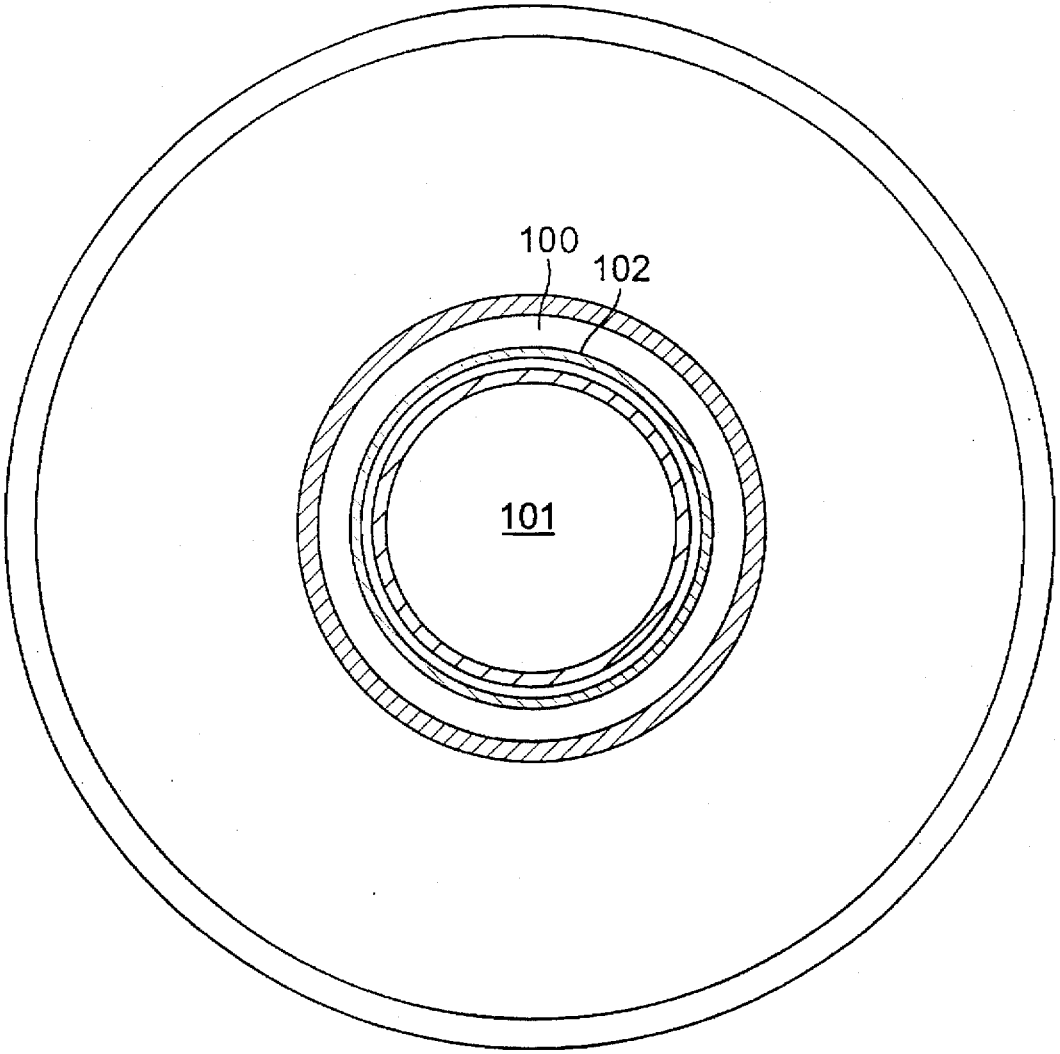
FIG. 5 is a cross-section of an alternative embodiment.

Other embodiments are within the claims. For example, in FIG. 5 the feed conduit and return conduit may be in a concentric configuration. When configured as such, the return conduit 100 may surround the feed conduit 101 with thermal insulation 102 between the two conduits. The insulation may be an evacuated chamber or a material with low thermal conductivity such as urethane foam or glass fiber.

What is claimed is:

1. A system for delivering controlled doses of liquid cryogen from an valved outlet comprising:

(a) a phase separating reservoir to contain cryogen in liquid and vapor phase, the reservoir being positioned above the outlet;

(b) a feed conduit for conveying liquid phase cryogen from the reservoir to the outlet; and (c) a return conduit communicating between a point P in the feed conduit immediately upstream of the outlet and vapor phase cryogen in the reservoir, the return conduit having a minimum cross-sectional area $A_R$;

the feed conduit and the return conduit being thermally isolated from each other, the feed conduit and the return conduit forming a circulation path comprising minimum cross-sectional area restriction $A_R$ designed to maintain flow in the circulation path, whereby liquid cryogen at point P is replenished from the reservoir as liquid is delivered from the outlet.

2. The system of claim 1 wherein the outlet comprises a dosing valve immediately downstream of point P.

3. The system of claim 2 wherein the dosing valve comprises a chamber communicating with a cryogen source to continuously bathe the valve in the liquid cryogen.

4. The system of claim 1 or claim 2 wherein the feed conduit has a first axis and the return conduit has a second axis, and the first axis is offset from the second axis.

5. The system of claim 4 further comprising thermally reflective foil surrounding, but not in direct contact with, the feed conduit, the foil being in contact with the return conduit.

6. The system of claim 4 comprising an insulating layer between the feed conduit and the foil.

7. The system of claim 1 or claim 2 wherein the feed conduit and the return conduit are concentric.

8. The system of claim 7, wherein the feed conduit is inside and insulated from the return conduit.

9. The system of claim 1 wherein the reservoir is positioned above the outlet a predetermined vertical distance D to provide a predetermined pressure head of liquid through the delivery conduit to point P.

10. A method of delivering controlled doses of liquid cryogen from an valved outlet comprising:

(a) positioning a phase separating reservoir containing cryogen in liquid and vapor phase above the outlet;

(b) flowing liquid phase cryogen through a feed conduit that extends from the reservoir to the outlet: and (c) providing a return conduit communicating between a point P in the feed conduit immediately upstream of the outlet and vapor phase cryogen in the reservoir, the return conduit comprising a minimum cross-sectional area $A_R$; the feed conduit and the return conduit being thermally isolated from each other;

(d) delivering cryogen from the outlet, the feed conduit and the return conduit forming a circulation path having minimum cross-sectional area restriction $A_R$ designed to maintain flow in the circulation path, whereby liquid cryogen at point P is replenished from the reservoir as liquid is delivered from the outlet.

11. The method of claim 10 wherein the outlet comprises a dosing valve immediately downstream of point P, and the method comprises repeatedly opening and closing the dosing valve to provide rapid controlled doses of cryogen delivered in pulses.

12. The method of claim 11 wherein the dosing valve comprises a chamber communicating with a cryogen source to continously bathe the valve in the liquid cryogen.

13. The method of claim 11 wherein cryogen circulates in the circulation path and the cryogen at point P is subcooled.

14. The method of claim 10 or claim 11 wherein the feed conduit has a first axis and the return conduit has a second axis, and the first axis is offset from the second axis.

15. The method of claim 10 wherein thermally reflective foil surrounds but is not in direct contact with, the feed conduit, the foil being in contact with the return conduit, whereby heat leak from outside the apparatus is diverted from the feed conduit to the return conduit.

16. The method of claim 15 wherein the feed conduit and the return conduit are not concentric, the foil extending around both the feed and the return conduit, with an insulating layer between the feed conduit and the foil.

17. The method of claim 10 or claim 11 wherein the feed conduit and the return conduit are not concentric.

18. The method of claim 15 wherein the feed conduit and the return conduit are concentric, the feed conduit being inside and insulated from the return conduit.

19. The method of claim 10 wherein the reservoir is positioned above the outlet a predetermined vertical distance D to provide a predetermined pressure head of liquid through the delivery conduit to point P.

* * * * *